US007096816B2

(12) United States Patent
Whited, II et al.

(10) Patent No.: US 7,096,816 B2
(45) Date of Patent: Aug. 29, 2006

(54) BOAT WINDSHIELD CANVAS ATTACHMENT APPARATUS

(75) Inventors: Sherman E. Whited, II, Sarasota, FL (US); Michael J. Bryant, Bradenton, FL (US); Brian K. Daniels, Bradenton, FL (US)

(73) Assignee: Ameritex Technologies, Inc, Bradenton, FL (US)

( * ) Notice: Subject to any disclaimer, the term of this patent is extended or adjusted under 35 U.S.C. 154(b) by 0 days.

(21) Appl. No.: 10/974,608

(22) Filed: Oct. 27, 2004

(65) Prior Publication Data

US 2005/0183652 A1 Aug. 25, 2005

Related U.S. Application Data

(60) Provisional application No. 60/514,705, filed on Oct. 27, 2003.

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 2,937,652 A 5/1960 Zimmer et al.
2,961,725 A 11/1960 McGee
3,093,845 A 6/1963 Brock et al.
3,172,419 A 3/1965 Lewis
3,304,657 A 2/1967 Singleton
4,993,351 A 2/1991 Zirkelbach et al.
D324,368 S 3/1992 Zirkelbach et al.
5,189,980 A 3/1993 Zirkelbach et al.
5,215,032 A 6/1993 Ellis et al.
5,339,763 A 8/1994 Erskine
5,367,977 A 11/1994 Ellis et al.
5,425,327 A * 6/1995 Zirkelbach et al. ..... 114/361
5,706,753 A * 1/1998 Menne et al. ..... 114/361
5,839,388 A 11/1998 Vadney
6,453,841 B1 9/2002 Shearer et al.

* cited by examiner

*Primary Examiner*—Stephen Avila
(74) *Attorney, Agent, or Firm*—Butzel Long

(57) ABSTRACT

An apparatus for enclosing an open area of a boat includes a canvas system with a fabric sheet having an edge formed thereon, a header extrusion mounted on an upper edge of a boat windshield, the header extrusion having a longitudinally extending and outwardly opening slot formed therein, and a plurality of fasteners attached to the fabric sheet at spaced apart locations, each fastener including a hook releasably engaged in the slot.

20 Claims, 3 Drawing Sheets

BOAT WINDSHIELD CANVAS ATTACHMENT APPARATUS

CROSS-REFERENCE TO RELATED APPLICATION

This application claims the benefit of U.S. provisional patent application Ser. No. 60/514,705 filed Oct. 27, 2003.

BACKGROUND OF THE INVENTION

The present invention relates generally to an apparatus for attaching a canvas top to a header of a boat windshield.

Most boats are provided with a cover or a canopy to partially or fully enclose an open area such as the cockpit of the boat. Such covers are often attached at a front edge to the header of the windshield assembly. The most common fasteners used are a round metal snap with a male portion affixed to the boat and a cooperating female portion attached to the cover. These fasteners are a source of problems due to exposure of the male portions when the cover is not in use, ease of breakage, and misalignment due to stretching or shrinking of the cover.

It remains desirable to provide an apparatus for attaching a canvas system to a header of a boat windshield that allows for easy attachment and removal of the canvas system in a cost effective and efficient manner.

SUMMARY OF THE INVENTION

The present invention concerns an apparatus for enclosing an open area of a boat comprising: a canvas system including a fabric sheet having an edge formed thereon; a header extrusion mounted on an upper edge of a boat windshield, the header extrusion having a longitudinally extending and outwardly opening slot formed therein; and a plurality of fasteners attached to the fabric sheet at spaced apart locations, each fastener including a hook releasably engaged in the slot.

The fasteners can be attached to the fabric sheet by in situ molding in a corresponding aperture formed in fabric sheet. Alternatively, the fasteners include an outer portion and an inner portion adhered together, the outer portion having a recess formed therein and the inner portion having a pin extending therefrom through an aperture formed in the fabric sheet and into the recess.

In another embodiment, the fasteners are formed of an outer portion and an integral inner portion, the outer portion extending through an aperture formed in the fabric sheet being deformed after installation. Alternatively, the fasteners have a body with the hook extending therefrom and a flange extending outwardly from the body and being attached to the fabric sheet.

A strip can be attached to the edge of the fabric sheet with the fasteners being attached to the strip. The fasteners each include a sloped lower end on the hook for assisting entry into and exit from the slot. Preferably, the fastener is formed from a plastic material. Each fastener can have a body and a post connecting the body with the hook. A reinforcing strip can be attached to the fabric sheet at the edge.

The advantages of the attachment apparatus in accordance with the present invention include: the fastener will not corrode; the fastener will not mar or scratch the windshield header extrusion regardless of the number of times the fasteners are attached and detached from the extrusion; and there are no exposed fasteners on the header extrusion when the canvas is removed, advantageously providing a smooth and visually pleasing appearance. This attachment apparatus also can be used on the windshield bottom extrusion and elsewhere on the boat.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
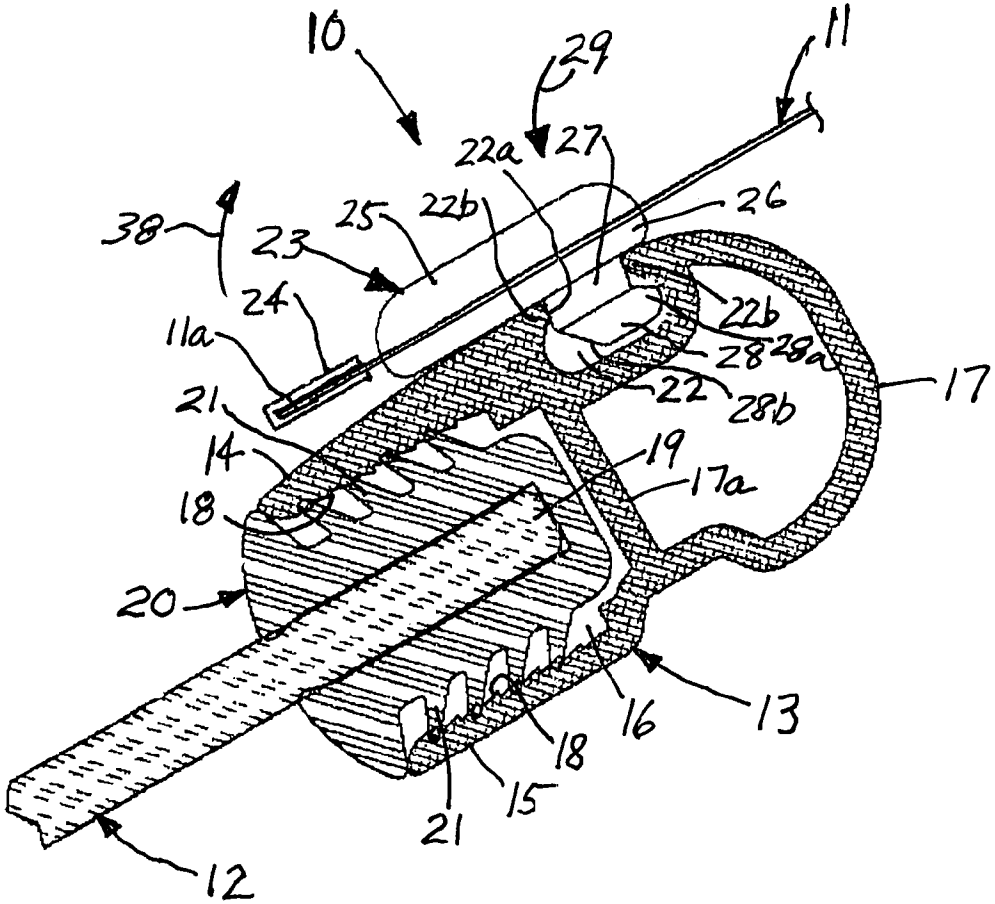
FIG. 1 is a cross-sectional view of an attachment apparatus in accordance with the present invention for attaching a canvas top to a boat windshield.

There is shown in FIG. 1 an attachment apparatus 10 for releasably attaching a boat canvas system including a fabric sheet 11 to a boat windshield glass 12. The canvas system can be any type such as a Bimini top, a camper or a cover that is adapted to enclose an open area of the boat partially bordered by the boat windshield glass 12. The windshield glass 12 is part of a windshield system that includes a header extrusion 13 mounted on and extending along a top edge of the glass 12. The terms "outer" and "outward", and variations thereof, as used herein refer to a direction facing outwardly from a cockpit of a boat (not shown) on which the windshield system is installed. The terms "inner" and "inward", and variations thereof, as used herein refer to a direction facing toward the cockpit of the boat. In FIG. 1, the outer side of the windshield glass 12 faces to the left and the inner side faces to the right.

The header extrusion 13 is formed of a suitable material, typically an aluminum material, and includes a pair of spaced apart downwardly extending legs, an outer leg 14 and an inner leg 15, defining a channel 16 therebetween having an open bottom. An upper end of the channel 16 is closed by a hollow head or cap 17. The head 17 includes a bottom wall 17*a* that extends between the legs 14 and 15. Facing surfaces of the legs 14 and 15 have serrations 18 formed thereon extending generally parallel to a longitudinal axis of the extrusion 13. An upper edge 19 of the windshield glass 12 is received in a channel of a generally U-shaped gasket 20 formed of a suitable resilient or elastic material such as rubber, vinyl, or the like. Each side surface of the gasket has a plurality of ribs 21 formed thereon extending generally parallel to a longitudinal axis of the gasket. When the upper edge 19 of the windshield 12 is received in the gasket 20 and the gasket 20 is inserted into the channel 16, the ribs 21 engage adjacent ones of the serrations 18 to robustly retain the header extrusion 13 on the upper edge 19 of the windshield 12. When assembled together, the windshield glass 12, the header extrusion 13, and the gasket 20 form the windshield system.

The head 17 has a longitudinally extending, outwardly opening slot 22 formed in an outer side surface adjacent an upper end of the outer leg 14. The slot 22 is configured to releasably retain a fastener 23 which, as described below, can be inserted anywhere along the length of the slot 22. The fastener 23 represents one of a plurality of such fasteners attached to the fabric sheet 11 at spaced apart locations along an edge 11*a*. In order to prevent fraying of the edge 11*a* and strengthen the canvas system, a reinforcing strip 24 is folded over the edge 11*a* and attached to the fabric sheet 11 by any suitable means such as sewing or gluing. The strip 24 can be formed of the same material as the sheet 11, or any other suitable material. The fastener 23 is shown in FIG. 1 as being attached to the fabric sheet 9, as described below, adjacent to the strip 24. However, the fastener 23 could be attached at the strip 24.

The fastener 23 is preferably formed of any suitable plastic material including, but not limited to nylon, polyacetal and Delrin (a registered trademark of E.I. du Pont de Nemours and Company) materials. The material must be somewhat resilient to permit a slight distortion during insertion into and removal from the slot 22, and strong enough to resist unintended disengagement from the slot 22 due to forces acting on the canvas system, for example wind and/or water. As shown in FIG. 1, the fastener 23 has a body extending through the fabric sheet 11 with an outer portion 25 abutting an outer surface of the fabric sheet and an inner portion 26 abutting an inner surface of the fabric sheet. A post 27 extends inwardly from the inner portion 26 into an opening 22*a* of the slot 22. The opening 22*a* is smaller in height than the slot 22 thereby forming a pair of opposed flanges 22*b*. A hook 28 extends outwardly and upwardly from an inner end of the post 27 to releasably engage an upper end 28*a* in an upper area of the slot 22 behind an upper one of the flanges 22*b*. An arrow 29 represents a path of insertion of the fastener 23 in the slot 22 as the upper end of the hook 28 is passed through the opening 22*a* and the fastener 23 is rotated in a counterclockwise direction to the installed position shown in FIG. 1. The hook 28 also includes a lower sloped end 28*b* that assists in insertion and removal of the fastener 23. Thus, the hook 28 and the slot 22 cooperate to provide "snap-in" and "snap-out" functions for the engagement and disengagement respectively of the canvas system and the windshield system.

Figure 2:
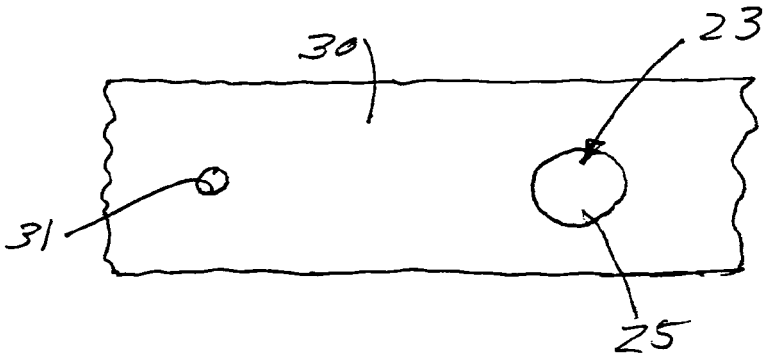
FIG. 2 is fragmentary plan view of the fastener shown in FIG. 1 installed in a fastener strip in accordance with an alternate embodiment of the present invention.

The fastener 23 can be installed directly in the fabric sheet 11 or in a separate strip that is attached, such as by stitching or the like to the fabric sheet 11. There is shown in FIG. 2 a portion of a strip 30 having one of the fasteners 23 installed therein. The fastener 23 is installed in one of a plurality of apertures 31 formed in the strip 30. One method of installation is to place the portion of the strip 30 surrounding the aperture 31 in a mold and form the fastener 23 in situ.

Figure 3:
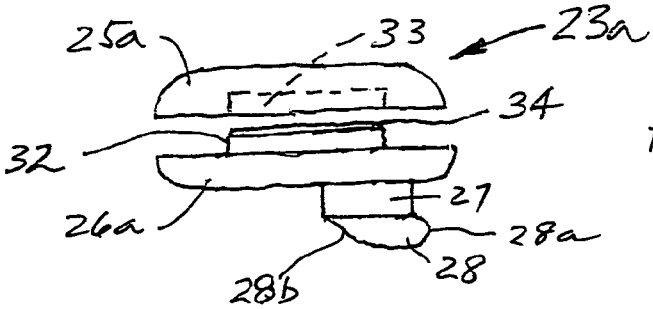
FIG. 3 is an exploded elevation view of a first alternate embodiment fastener according to the present invention.

A first alternate embodiment fastener 23*a* is shown in FIG. 3. An inner portion 26*a* has the post 27 and the hook 28 formed thereon and is separate from an outer portion 25*a*. The inner portion 26*a* has a pin 32 formed thereon that is received in a recess 33 formed in the outer portion 25*a*. The pin 32 can be retained in the recess 33 by a suitable adhesive 34 or by any other suitable means such as ultrasonic welding or the like after installation on the fabric sheet 11.

Figure 4:
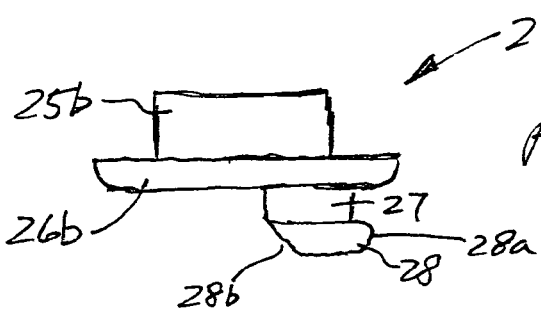
FIG. 4 is an elevation view of a second alternate embodiment fastener according to the present invention.

A second alternate embodiment fastener 23*b* is shown in FIG. 4. An inner portion 26*b* has the post 27 and the hook 28 formed thereon. Formed on the opposite side of the inner portion 26*b* from the post 27 is an outer portion 25*b*. The outer portion 25*b* has a diameter that permits it to pass through the aperture 31 (FIG. 2). The height of the outer portion 25*b* is selected to provide a material volume to enable forming into a shape similar to the outer portions 25 and 25*a* by any suitable means, such as a holt melt operation, after installation in the aperture 31.

Figure 5:
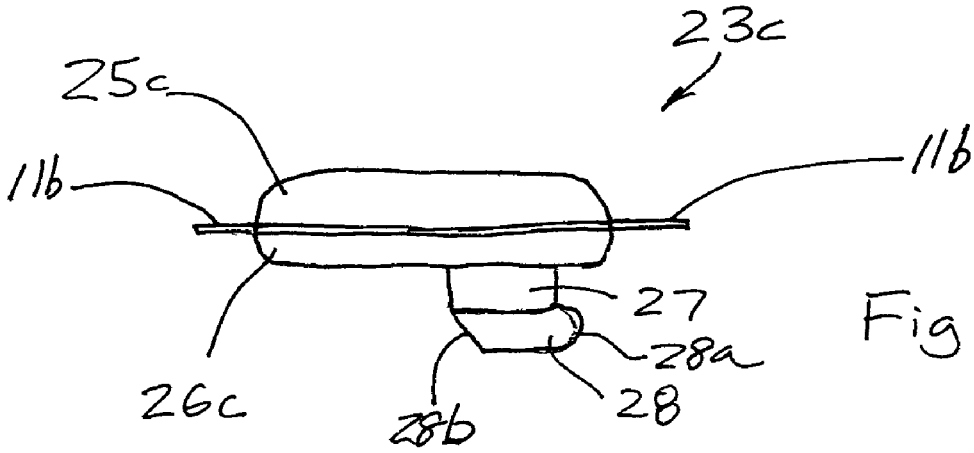
FIG. 5 is an elevation view of a third alternate embodiment fastener according to the present invention.

A third alternative embodiment fastener 23*c*, similar to the fastener 23 of FIG. 1, is shown in FIG. 5. The fastener 23*c* includes an outer portion 25*c* and an inner portion 26*c* having the post 27 and the hook 28 formed thereon. A thin flange 11*b* extends radially outwardly at a junction of the outer portion 25*c* and the inner portion 26*c*. The flange 11*b* defines a surface upon which the fastener 23*c* may be sewn or similarly attached to the fabric sheet 11 or strip 30 after the fastener 23*c* is placed in the aperture 31 or 35 (shown in FIG. 7) during assembly of the canvas system.

Figure 6:
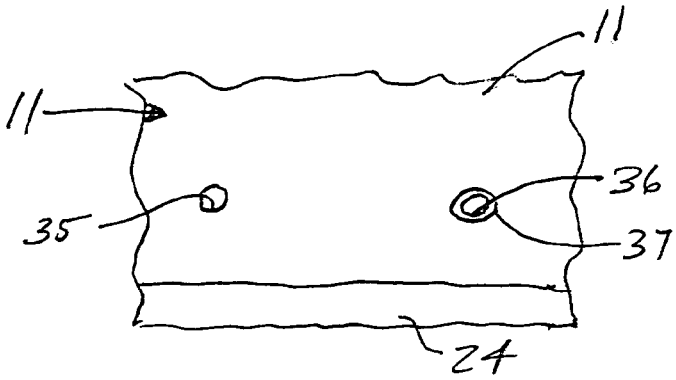
FIG. 6 is a fragmentary plan view of the canvas shown in FIG. 1.

A portion of the canvas 11 is shown in FIG. 6 to illustrate the aperture 35 formed therein suitable for receiving one of the fasteners 23, 23*a*, 23*b* and 23*c*. If additional reinforcing is required, an aperture 36 can receive a grommet 37 made of any suitable material such as metal or plastic material.

When it is desired to detach the canvas system from the windshield system, the edge 11*a* at the reinforcing strip 24 is grasped and moved in a direction, indicated by an arrow 38, that is opposite to the direction of the engagement arrow 29. The force applied rotates the fastener 23 in a clockwise direction and remove the post 27 and the hook 28 from the slot 22 to release the canvas system from the windshield system. The sloped surface 28*b* on the hook 28 of the fasteners 23, 23*a*, 23*b*, and 23*c* assists in the removal from the slot 22 by providing a ramp surface that slides against the lower flange 22*b*. Similarly, the sloped surface 28*b* assists in the installation of the fasteners 23, 23*a*, 23*b*, and 23*c* into the slot 22 when the canvas system is being attached to the windshield system.

Advantages of the attachment apparatus 10 according to the present invention over prior art attachment systems include: that the fasteners 23, 23*a*, 23*b* and 23*c* will not corrode; the fasteners 23, 23*a*, 23*b* and 23*c* will not mar or scratch the header extrusion 13; the fasteners 23, 23*a*, 23*b* and 23*c* do not have to be aligned with complementary fasteners fixed on the header extrusion 13; and there are no exposed fasteners on the header extrusion 13 when the canvas system is removed. The attachment apparatus 10 also can be used on a windshield bottom extrusion (not shown) or any other extrusion on the boat that is provided with the slot 22. Furthermore, the slot 22 and the hook 28 could be rotated 180° and function in a similar manner.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for attaching a canvas system to a boat comprising:

an extrusion adapted to be mounted on a boat and having a longitudinally extending slot formed therein, said slot having an opening of smaller height than a height of said slot forming a flange;

a fabric sheet; and a plurality of fasteners passing through and attached to the fabric sheet in spaced apart relationship, each said fastener including a hook sized to pass through said opening into said slot and releasably engaged behind said flange, whereby when said fasteners are attached to the sheet and said hooks engage in said slot, the sheet covers said opening of said slot.

2. The apparatus according to claim 1 wherein said fasteners are formed from a plastic material.

3. The apparatus according to claim 1 wherein said fasteners are attached to the fabric sheet by in situ molding.

4. The apparatus according to claim 1 wherein each said fastener has a body from which said hook extends and a flange extending outwardly from said body and adapted for attachment to the fabric sheet.

5. The apparatus according to claim 1 wherein said extrusion includes a pair of legs defining a channel therebetween and a gasket retained in said channel, said gasket being adapted to receive a boat windshield.

6. The apparatus according to claim 5 wherein said gasket includes a plurality of ribs extending therefrom cooperating with a plurality of serrations extending from facing surfaces of said legs.

7. The apparatus according to claim 5 wherein said slot is formed adjacent an upper end of an outer one of said legs.

8. An apparatus for enclosing an open area of a boat comprising:

a canvas system including a fabric sheet having an edge formed thereon;

a header extrusion mounted on an upper edge of a boat windshield, said header extrusion having a longitudinally extending and outwardly opening slot formed therein; and a plurality of fasteners extending through and attached to said fabric sheet at spaced apart locations, each said fastener including a hook releasably engaged in said slot whereby said sheet covers said slot.

9. The apparatus according to claim 8 wherein each said fastener is attached to said fabric sheet by in situ molding in a corresponding aperture formed in said fabric sheet.

10. The apparatus according to claim 8 wherein each said fastener includes an outer portion and an inner portion adhered together, said outer portion having a recess formed therein and said inner portion having a pin extending therefrom through an aperture formed in said fabric sheet and into said recess.

11. The apparatus according to claim 8 wherein each said fastener is formed of an outer portion and an integral inner portion, said outer portion extending through an aperture formed in said fabric sheet being deformed after installation.

12. The apparatus according to claim 8 wherein said fastener has a body with said hook extending therefrom and a flange extending outwardly from said body and being attached to said fabric sheet.

13. The apparatus according to claim 8 including a strip attached to said edge of said fabric sheet, said fasteners being attached to said strip.

14. The apparatus according to claim 8 wherein said fasteners each include a sloped lower end an said hook for assisting entry into and exit from said slot.

15. The apparatus according to claim 14 wherein each said fastener is formed from a plastic material.

16. The apparatus according to claim 14 wherein each said fastener has a body and a post connecting said body with said hook.

17. The apparatus according to claim 14 including a reinforcing strip attached to said fabric sheet at said edge.

18. An apparatus for attaching a canvas system to a boat comprising:

an extrusion adapted to be mounted on a boat and having a longitudinally extending slot formed therein, said slot having an opening of smaller height than a height of said slot forming a flange; and a plurality of fasteners adapted to pass through and be attached to a fabric sheet in spaced apart relationship, each said fastener including a hook sized to pass through said opening into said slot and releasably engaged behind said flange, whereby when said fasteners are attached to the sheet and said hooks engage in said slot, the sheet covers said opening of said slot, and wherein each said fastener is formed of an outer portion having a recess and an inner portion having pin, said pin being inserted in said recess.

19. The apparatus according to claim 18 including an adhesive material adhering said outer portion and said inner portion together.

20. An apparatus for attaching a canvas system to a boat comprising:

an extrusion adapted to be mounted on a boat and having a longitudinally extending slot formed therein, said slot having an opening of smaller height than a height of said slot forming a flange; and a plurality of fasteners adapted to pass through and be attached to a fabric sheet in spaced apart relationship, each said fastener including a hook sized to pass through said opening into said slot and releasably engaged behind said flange, whereby when said fasteners are attached to the sheet and said hooks engage in said slot, the sheet covers said opening of said slot, and wherein each said fastener is formed of an outer portion and an inner portion, said outer portion being formable after installation in an aperture formed in the fabric sheet to affix said fastener to the fabric sheet.

* * * * *